United States Patent [19]

Hagan

[11] Patent Number: 4,694,975

[45] Date of Patent: Sep. 22, 1987

[54] METHOD AND APPARATUS FOR STORING AND DISPENSING FLUIDS CONTAINERED UNDER GAS PRESSURE

[75] Inventor: Richard J. Hagan, San Carlos, Calif.

[73] Assignee: McKesson Corporation, Los Angeles, Calif.

[21] Appl. No.: 924,186

[22] Filed: Oct. 24, 1986

Related U.S. Application Data

[63] Continuation of Ser. No. 685,912, Dec. 27, 1984, abandoned, which is a continuation-in-part of Ser. No. 609,280, May 10, 1984, abandoned.

[51] Int. Cl.[4] ..... B67B 7/00; B65D 83/00

[52] U.S. Cl. ..... 222/1; 222/402.13; 222/402.25; 222/464; 222/545; 215/4; 251/335.2

[58] Field of Search ..... 222/545, 402.13, 402.25, 222/394, 402.1, 402.15, 464, 541, 505, 635, 182, 153, 3, 1; 251/335.2; 215/4, 315, 311; 220/89 A, 85 P; 169/75; 141/14–17, 386, 326, 327, 390, 382

[56] References Cited

U.S. PATENT DOCUMENTS

| | | | |
|---|---|---|---|
| 487,366 | 12/1892 | Fuller | 222/541 |
| 676,009 | 6/1901 | Ripper | 222/394 |
| 710,674 | 10/1902 | Fassmann | 222/505 |
| 1,022,301 | 4/1912 | Campbell | 220/89 A X |
| 1,711,537 | 5/1929 | Lewis et al. | 251/335.2 |
| 1,977,328 | 10/1934 | Sousley | 222/464 |
| 2,372,392 | 3/1945 | Pletman | 222/402.25 |
| 2,830,745 | 4/1958 | Aicart | 222/402.25 X |
| 3,259,194 | 7/1966 | McCrossan | 222/394 X |
| 4,286,735 | 9/1981 | Sneider | 222/464 X |
| 4,502,618 | 3/1985 | Bushell | 222/396 |
| 4,545,759 | 10/1985 | Giles et al. | 222/3 X |

FOREIGN PATENT DOCUMENTS

| | | | |
|---|---|---|---|
| 77139 | 6/1948 | Czechoslovakia | 222/509 |
| 414379 | 7/1964 | Switzerland | 222/402.15 |
| 869679 | 6/1961 | United Kingdom | 222/402.25 |

*Primary Examiner*—Joseph J. Rolla
*Assistant Examiner*—Gregory L. Huson
*Attorney, Agent, or Firm*—Flehr, Hohbach, Test, Albritton & Herbert

[57] ABSTRACT

A method and apparatus for storing and dispensing fluids such as syphon seltzer water under about 10 atmospheres of pressure. A plastic bottle is provided in which a valve mechanism is inserted within the neck of the bottle. A disposable cap covers the end of the bottle to prevent contamination of the valve during storage. When the contents of the bottle are to be dispensed, the cap is removed and discarded and a head member is attached to the outside wall of the neck of the bottle. The head contains a valve actuation mechanism which opens the valve and the liquid is dispensed through a nozzle in the head. The head may be removed when the contents of the bottle are dispensed or at any time before being fully dispensed. The bottle is discarded or recycled and the head member is detached and reattached to a full bottle of liquid, such as syphon seltzer water.

13 Claims, 14 Drawing Figures

METHOD AND APPARATUS FOR STORING AND DISPENSING FLUIDS CONTAINERED UNDER GAS PRESSURE

PRIOR APPLICATION

This application is a continuation of Ser. No. 685,912, filed Dec. 27, 1984, now abandoned, which is a continuation-in-part of my prior application Ser. No. 06/609,280, filed May 10, 1984, and now abandoned.

BACKGROUND OF THE INVENTION

1. Field of the Invention

This invention relates to the storage and dispensing of water or flavored beverages under gas pressure of between 90 and 150 psi (10 atmospheres). Such products are commonly known as syphon seltzer water, as distinguished from present day bottled sparkling waters or lightly carbonated flavored beverages which are charged to pressures of 50 to 60 psi (3 to 4 atmospheres). For further purposes of comparison, champagne is under about 6 to 7 atmospheres of pressure.

2. Description of the Prior Art

Although the syphon seltzer water industry was a giant at the turn of the century and reached its zenith in the 1920s, today it is remembered mostly by the classic syphon seltzer bottle which was used as a comedy prop by the Marx Brothers and The Three Stooges to squirt each other in wild water fights. The New York area alone at one time had 2,000 syphon seltzer companies. Today there are about a dozen seltzer bottlers in the United States. There are only two syphon seltzer bottlers west of Chicago.

The syphon seltzer industry died after World War II and remains as a nostalgic, marginally profitable local business carried on by only a handful of energetic young folk who hand fill and hand deliver the old-fashioned syphon seltzer water to a fiercely loyal group of purists who want nothing more and nothing less than thrice-filtered water and carbon dioxide. There are no salts; no flavors; no preservatives, a trio that is sweet music to the palates of the health conscious.

Syphon seltzer water, up until now, however, because of the use of high pressures in glass bottles was a victim of several factors: (1) the high cost of products liability insurance; a heavy glass bottle exploding under a pressure of 150 psi can inflict awesome damage; (2) the high cost of heavy glass bottle manufacture; (3) the high cost of tin, rubber, and brass used in the manufacture of the pewter heads and valves; (6) the high cost of bottle delivery and pick-up of the heavy, fragile bottles; (7) the high cost and difficulty in sanitizing the returned bottles, and especially the returned heads and valves; and ultimately (8) the switch by the mass market to lightly carbonated flavored drinks in disposable cans and thin bottles. The syphon seltzer water industry died, not for a good product, but for the variety of reasons set forth above which related to its storage, distribution and dispensing problems.

A brief background, therefore, of the seltzer industry and the syphon seltzer container is necessary to an understanding of the dramatic change this invention brings to an industry which has essentially stood still for the last sixty years.

Mineral waters with light natural carbonation were enjoyed by earliest man; the Romans knew about them but used the water more for bathing than drinking, witness Bath. The Germans and the French considered the mineral waters to have curative powers and they live today in such industries as Vichy, and Perrier. Of course, the mineral waters from the early spas could not be transported very far, because heat and lack of pressurized vessels took its toll on the taste and effervescent quality of the water. In 1772, a British scientist, Joseph Priestly, better known for his discovery of oxygen, succeeded in producing artificially carbonated water. He made it in barrels and the race for a container was on. The British Navy mixed the carbonated water with lime juice and later the practice was adopted through the Royal Navy to prevent the sailors from getting scurvy from their vitamin-deficient diet; hence the term "Limeys". Nicholas Paul of Geneva is credited with starting to manufacture imitation spa waters in bulk in 1789 and one of his partners, Jacob Schweppe, four years later started making soda water.

The manufacture of carbonated water in the United States began in the early part of the 19th Century. A patent was granted in 1810 for saturating water with "fixed air."

INVENTION OF THE SYPHON BOTTLE

Charles Plinth is credited as being the first to preserve "aerated waters" in a reservoir which would deliver a portion of its contents at different times. His patent on a Regency portable fountain in 1813 was identical in construction with the fountains then commonly used in which the motive force was compressed atmospheric air. Plinth substituted carbonic acid gas for air in his apparatus. It consisted of a vessel with a tube passing from an opening in the top almost to the bottom; the upper part of the tube was furnished with a stopcock and delivery tube, from which the water was drawn off under pressure of the carbonic acid gas.

Deleuze and Dutillet, Paris jewellers, who apparently were adverse to consuming an entire bottle of champagne at one sitting were granted a patent in 1829 on a "siphon champenois" which consisted of a hollow corkscrew which was passed through the cork into the bottle. The upper part of the screw terminated in a vertical tube bearing a nearly horizontal spout. A lever operated a valve, which when opened and the bottle was tipped, gave exit to the champagne under pressure of the contained gas.

The forerunner of the present day syphon seltzer bottle was patented in 1837 by Antoine Perpigna of Paris, France. The vase was made of metal, glass, china or stoneware and the head of the syphon was hollow and contained a piston, pressed down by a spring into close contact with the upper end of the tube passing to the bottom of the vase. The method of attaching these early head mechanisms to the bottle or vessel is unknown to applicant but it appears from the articles that there was some sort of external collar mechanism, or perhaps the head mechanism which protruded above the bottle was adhesively affixed to the bottle.

The split collar mechanism which was universally adopted and is still in use today was invented in about 1855 by the Comte de Fontainemoreau and George Rogers. They used a bottle made with a groove around the outer wall of the neck into which was fitted a ring of metal divided into two segments which formed a shoulder for securing a screwed collar.

The problem with the Rogers mechanism and virtually every mechanism for syphon seltzer water to the present day is the fact that the head mechanism, containing the valve and spout, must be assembled on the bottle before filling. The bottle is filled through the head mechanism and the entire assembly of head and filled water bottle must be transported from the factory, through the distribution chain, to the customer and then after the contents are emptied, the bottle and head must be returned through the distribution chain, back to the factory for filling. After sanitizing, the bottle is refilled through the head. Again, the seltzer industry as it was known for one hundred years, died because of the lack of a container system, not because any superior product replaced it.

SUMMARY OF THE INVENTION

The present invention recognizes and fulfills the one basic commercial fact of our day; a beverage product must meet all of the requirements for distribution and sale through our present day supermarket system. These requirements are (1) Safety; the container must not explode even if mishandled. (2) Inexpensive; the bottle and valve must be so inexpensive that they need not be returned and routed back through the chain of distribution to the factory. (3) The bottle and valve must be light weight; water is already a heavy product and the container cannot add appreciably to the weight or containers of sufficient volume cannot be handled through the checkout stand and be bagged along with other grocery products. (4) The bottle must be made of a material that can be recycled in those states which have instituted laws for the recycling of containers. (5) The head mechanism must be simple, yet easily attached and detached from the container so that most everyone can accomplish the process without any danger or effort.

The key to the accomplishment of the above objectives is the separation of the head and valve actuation function from the valve and seal function and the selection of a high strength, non-frangible container. Specifically, the valve and seal mechanism are contained almost totally within the neck of the container, while the head, which contains the valve actuator, is a separate member which can be retained by the consumer and used over and over again. The container may be charged up to 150 psi. To emphasize the high capacity of the container, it is to be noted that 150 psi is the bursting pressure of standard glass bottles used for lightly carbonated beverages.

A container system for storing and dispensing a pressurized fluid in accordance with this invention includes a substantially non-frangible container having a necked opening with an inside surface. A valve insert is fixedly attached to the inside surface of the necked opening. A removable cap is attached to the necked opening over the valve insert. A dispensing head is configured for fixed, removable engagement over the necked opening after removal of the cap. The dispensing head includes a body having an opening for discharge of the fluid and a valve actuating member in the head configured for operative engagement of the valve when the dispensing head is in fixed engagement over the necked opening. The head has a means for attaching the head in fixed engagement over the necked opening, such as threads on the head body.

In practice, the non-frangible container is fitted with the valve mechanism. The container is filled with carbonated water to a pressure from about 90 to 150 psi. A standard aluminum screw type cap or other simple closure is placed on the bottle. The cap is under no pressure and merely serves to protect the valve from contamination and accidental discharge if the valve should break away from the neck. The container is distributed through the standard distribution channels like any other bottled or canned beverage, without any special precautions and shelved in a supermarket along with the standard lightly carbonated flavored beverages, which are under the greatly reduced pressure of about 50 to 60 psi. The container is distributed and shelved without the head and spigot mechanism. The head and spigot may be sold separately or distributed free of charge with the sale of one or more containers. The customer refrigerates the container of seltzer water and, before using, removes the disposable cap and attaches the head mechanism to the container. The high pressure is sufficient to discharge the entire contents of the container without appreciable loss of carbonation due to the use of the syphon tube. When the entire contents of the container have been discharged, the head may be detached and placed on a freshly refrigerated container of seltzer water. The used syphon seltzer non-frangible container may be discarded or recycled by returning it to a recycling center as desired.

When the head is tightly attached to the container, should the valve leak, the head will hold the pressure. In the unlikely event that the valve should break away from the neck of the container, the head would safely hold the damaged valve within the head.

Unlike standard syphon seltzer bottles which may be accidentally discharged while being carried by simply pressing down on the lever on the head mechanism, the present containers cannot be accidentally discharged. The head is never placed on the container until it is ready for use. The only way to discharge the container of the present invention while it is in the distribution chain is to remove the protective cap, throw it away, and then poke a small long, sharp object down through a small hole in the valve which is down inside the neck of the container. Note that the cap may be provided with a tamper proof lower skirt.

DESCRIPTION OF THE PREFERRED EMBODIMENTS

Figure 1:
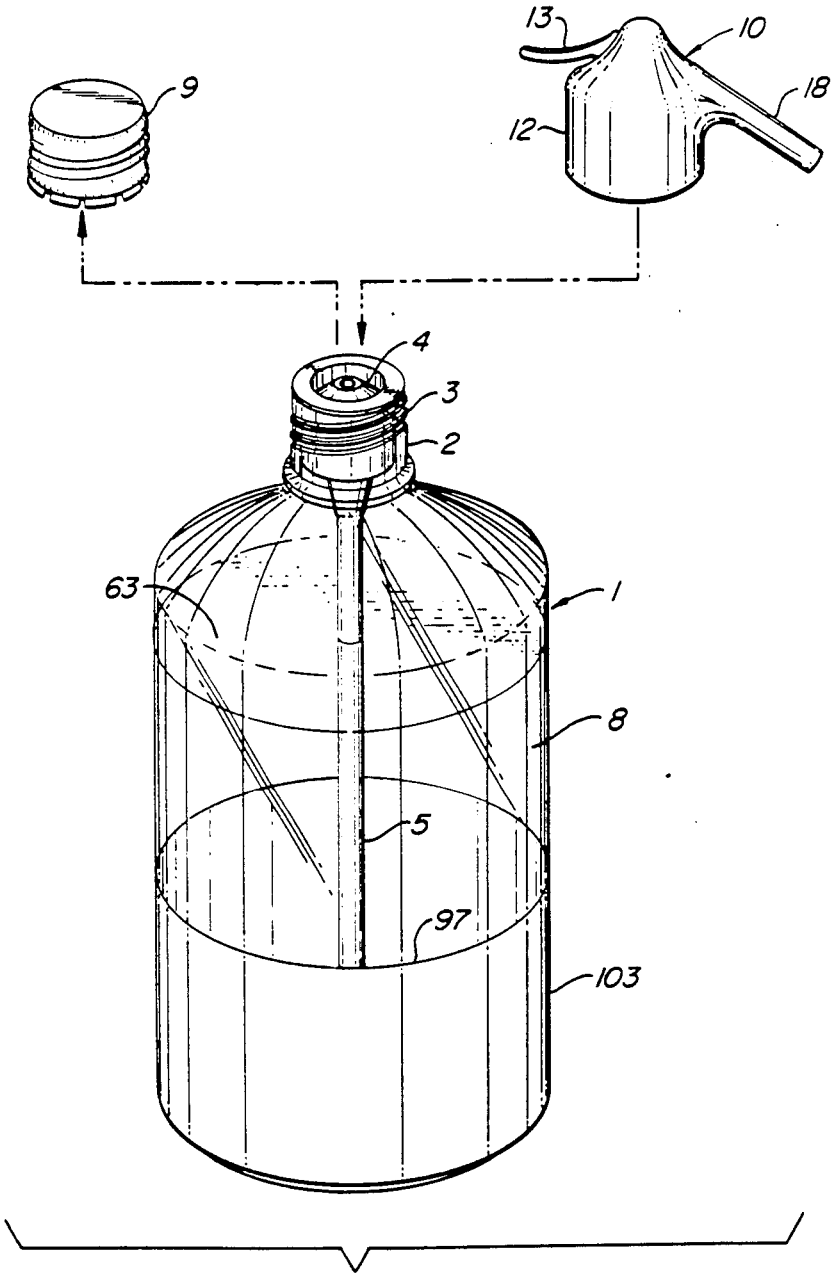
FIG. 1 is a perspective view of the container of the present invention with the valve inserted and the cap and head removed.

Turning now to the drawings, more particularly to FIG. 1, the method of the present invention for storing and dispensing fluids containered under gas pressure comprises selecting a plastic, metal, composite or other substantially non-frangible container 1 capable of safely withstanding in excess of three atmospheres of pressure and preferably a 1.8 liter bottle capable of safely carrying liquids at 150 psi (10 atmospheres). The container is formed with a neck portion 2 having an external attachment member 3. Preferably, the bottle is an 18 to 20 mil polyester terephthalate (PET) bottle. Polyester terephthalate (PET) is furnished by various manufacturers, including Eastman Chemical Products, Inc. One of the manufacturers of the bottle is Plaxicon Company in the City of Industry, Calif. using equipment and molds manufactured by NISI ASB Machine Company, Ltd. of Japan, with offices in Torrance, Calif. The unusually high strength is due to the bi-axial orientation of the molecules in the plastic. Additional information on bottle manufacture is set forth in "A Layman's Guide to Pet Chemistry and Processing", Edward E. Dennison, Eastman Chemical Products, Inc. and "One-Stage Processing of Pet Bottles", Eastman Kodak Company. The external attachment member on the outside wall of the neck may be the formation of screw threads 3 in the plastic.

A valve means 4 is selected which is mounted substantially within the container neck portion for maintaining gas pressure of at least three atmospheres and preferably up to about 150 psi or about 10 atmospheres. A tube 5, commonly known as a syphon tube, is connected to the valve and has a distal end 6 which extends to a point adjacent to the bottom 7. The fluid flows up through the hollow syphon tube and through the valve when opened. The container is filled with liquid 8, such as carbonated water pressurized to about 10 atmospheres.

A cap member 9 for removably covering the opening in the neck portion of the bottle is selected, which is removed prior to placing the head on the bottle and dispensing the fluid. The cap preferably is of light weight aluminum formed with internal threads, tamper proof and recyclable or disposable. The cap should have a thin flexible seal member 54 (FIG. 2) for preventing the inside of the bottle and valve from becoming contaminated in the distribution system. The cap is not under pressure, unlike all caps for lightly carbonated beverages.

The last step in the method is to select a head member 10, which is removably affixed to the external attachment member on the neck portion of the container. A preferred means of attachment is by internal threads 11 formed on the inside of wall 12 of the head member. The head member has a manually engageable valve actuating member, such as a lever 13. A remote valve actuating member, such as a pin 14, is selectively operable by the valve actuating member and is positioned for engagement with the valve means. A substantially impermeable liquid and gas sealing means, such as a rubber membrane 15, separates the manually engageable valve actuating member 13 and the remote valve actuating member 14. The head is formed with a chamber 16 which receives the fluid and channels it to a channel 17 in spout 18.

Figure 2:
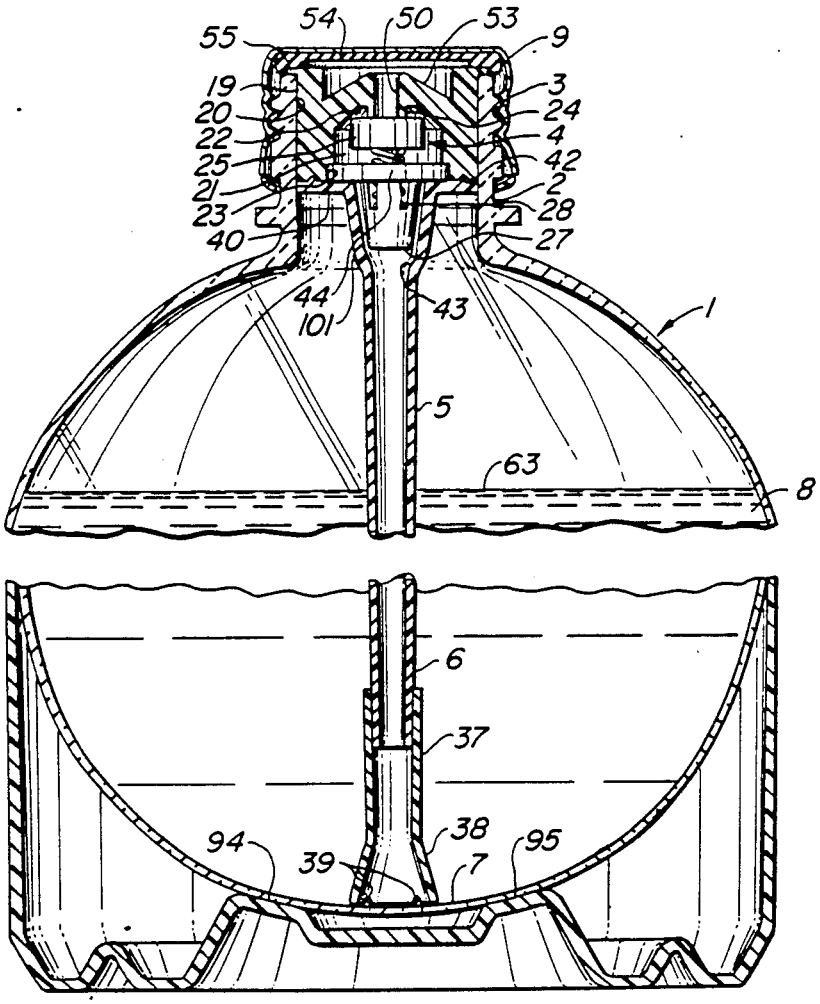
FIG. 2 is a cross sectional view of the container of FIG. 1 shown in an enlarged scale with the midsection of the container removed. Portions of the valve mechanism are not shown in section for purposes of clarity in showing their relationship with the rest of the mechanism. The preferred valve and plug apparatus is shown. One of the forms of the syphon tube is shown.
Figure 3:
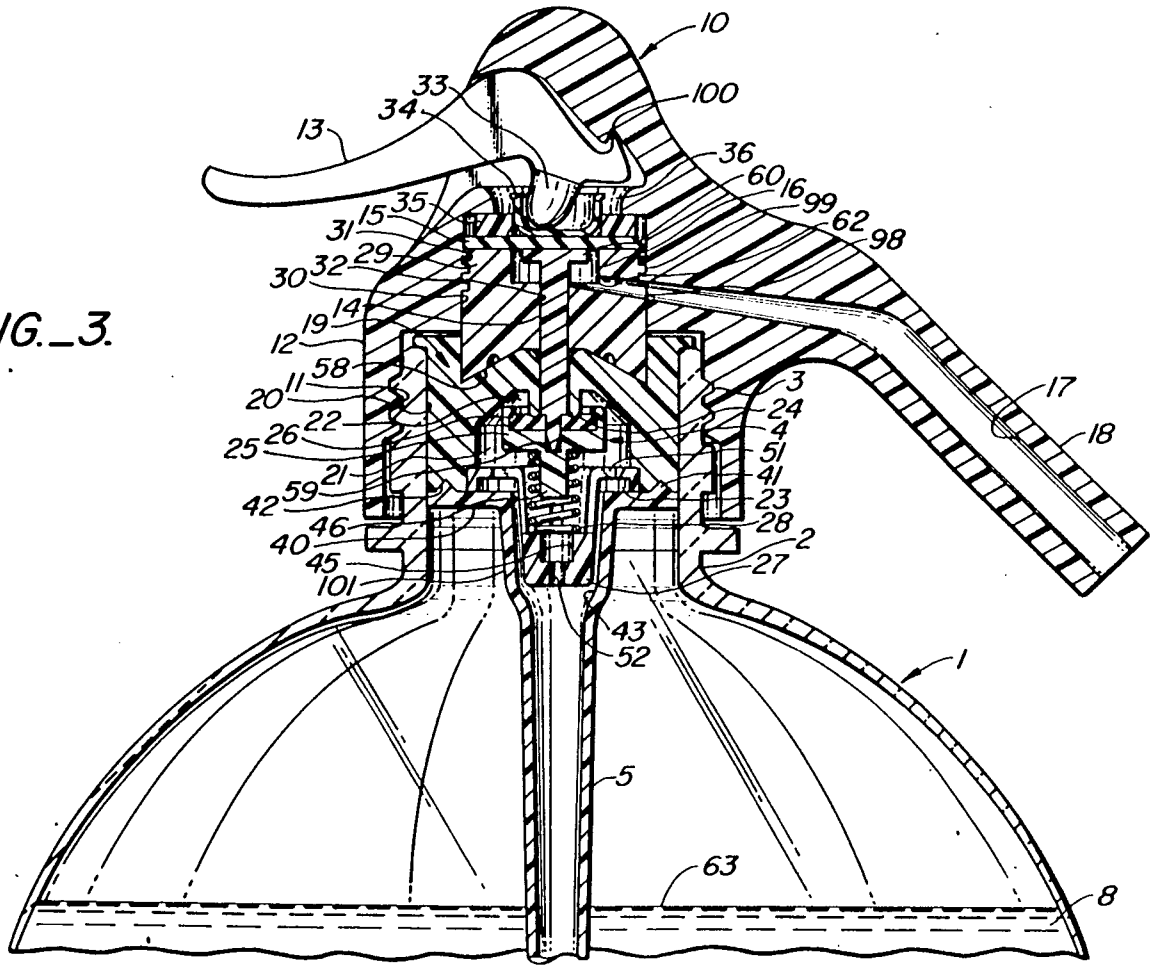
FIG. 3 is a cross section of a portion of the container on an enlarged scale with the cap removed and a head member attached to the form of the valve shown in FIG. 2.
Figure 4:
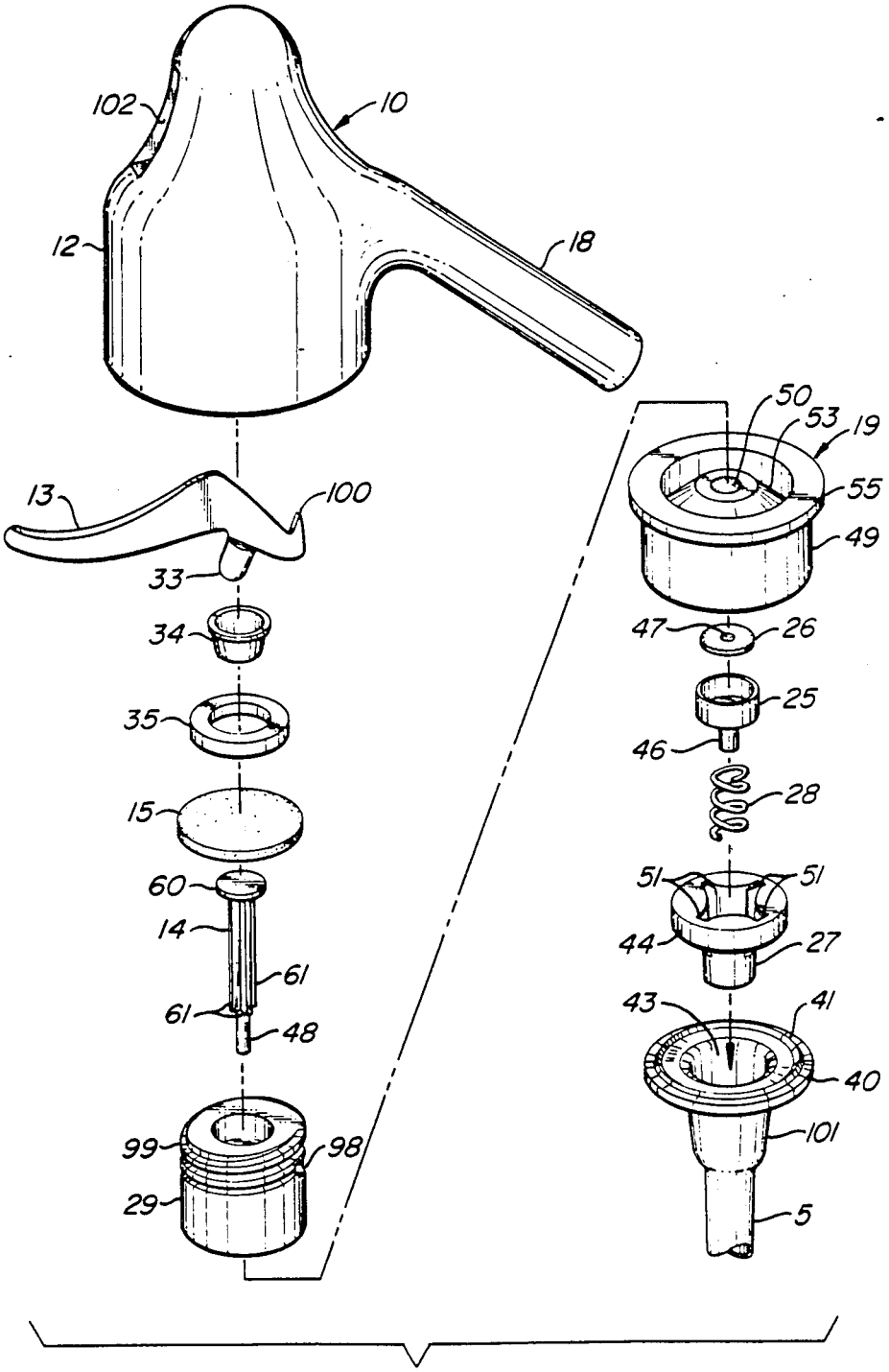
FIG. 4 is an exploded perspective view of the head, valve and a portion of the syphon tube shown in FIGS. 1–3.

In FIGS. 2, 3, and 4, a safety neck plug member 19 is shown which encloses the valve means and is integrally connected to the syphon tube 5. The neck plug member is preferably attached to the inside wall 20 of the container by an adhesive. A suitable adhesive is General Electric RTV Silicone Adhesive. Another method of attaching wall 49 of neck plug 19 is to use a solvent to soften the PET and weld the plug to the neck wall of the container. Spin welding may also be employed.

Continuing to refer to FIGS. 2, 3, and 4, the valve means includes an inner chamber 21 formed in neck plug member 19 having upper and lower portions 22 and 23. A valve seat 24 is formed in the upper portion of the valve chamber. This may simply be an annular protrusion. A valve cup 25 is positioned for registration with the valve seat in a valve closed position and is movable to a valve open position away from the valve seat. Sealing means, such as a rubber washer 26, is positioned within the cup for sealing registration with the valve seat in the valve closed position. A spring retainer member 27 is mounted in the lower portion 23 of the chamber 21 and flared portion 101 of the syphon tube and a spring member 28 is mounted in the spring retainer member and biases the valve cup to the valve closed position.

The manually operable means for selectively opening the valve for release of the contents of the container may be any member capable of depressing the valve cup 25. A suitable head member 10 is illustrated in FIGS. 3 and 4 for actuating the valve. A guide member 29 having threads 99 is threadably inserted into an opening 30 formed in the head to engage head internal threads 31. Pin 14 is mounted for vertical reciprocation within opening 32 of the guide member. Lever 13 is formed with a protrusion 33 which bears on cup 34. Injection molded plastic washer 35 bears against annular protrusion 36 which surrounds cup 34. The lever pivots about end point 100.

Assembly and operation of the valve and head illustrated in FIGS. 2–4 is as follows. A syphon tube 5 is selected having a length which will reach to a point adjacent the bottom of the container. Since the container is plastic and will expand with increased pressure from increased temperature and shrink with the loss of pressure, it is advisable to select an end member 37 which is frictionally placed over the distal end 6 in a telescoping manner so that if the bottom of the bottle pushes up 37 against flared end 38, the end member 37 will simply slip over the distal end 6. Note that openings 39 formed in the end member 37 permit liquid to flow into the syphon tube even though the end member is pressed tightly against the bottom wall of the bottle. Syphon tube 5 is formed with an outwardly extending flange 40. An annular rib 41 registers with a matching groove 42 in the plug member 19. Spring retainer 27 snap fits into the bottom of plug 19 and is inserted into enlarged opening 43. Spring 28 is then placed in the spring retainer so that its bottom end rests on abutment 45 and the top portion encircles protrusion 46 on valve cup 25. Rubber washer 26 is placed in valve cup 25, which in turn is placed on the spring 28. Note that washer 26 may be formed with a small opening 47 to retain the end 48 of pin 14. Safety neck plug member 19 is then adhered to flange 40 of the syphon tube thereby compressing spring 28 and forcing sealing washer 26 into sealing engagement with valve seat 24 formed in the plug member. The entire plug and syphon tube assembly is then placed into the container and the side wall 49 is adhered to the inner neck wall of the container by a suitable adhesive or by spin welding.

Filling of the container with carbonated water is as follows. A suitable filling apparatus depresses valve cup 25 and the liquid enters through opening 50 in plug member 19 and into inner chamber 21. The water is forced past openings 51 and 52 and into syphon tube 5. The water flows through end member 37 and then into the bottle. When the container is filled to the desired amount, the valve cup is released and spring 28 forces the cup and washer 26 into sealing engagement with valve seat 24. Pressure in the container also tends to force washer 26 into sealing engagement. A cap 9 is then threaded onto the container to prevent contamination of the end surface 53 and opening 50 of the plug. The cap member may be provided with a flexible sealing member 54 to further enhance the seal to prevent contamination. As previously noted, the cap is not under any pressure since the container pressure is entirely held by the sealing washer 26 within the safety plug.

Another important feature is the fact that the entire valve means and plug member is within the neck of the bottle except for a thin flange 55 which may rest on the upper rim 56 of the bottle. Flange 55 mechanically prevents the plug from slipping inside the bottle when the plug is first assembled and adhered to the inside wall of the neck of the container. It may also serve to provide an abutment when the cap is screwed onto the bottle.

The container is shipped through the distribution chain with the cap on and without any head mechanism. The container is shelved in supermarkets and other retail stores, where it is purchased directly by the ultimate consumer and carried to a home or business place. The container is chilled in the refrigerator and, when ready for consumption, the cap 9 is removed from the bottle and the head member 10 is screwed onto the container. The guide member 29 mates with conical surface 53, which is a rigid non-compressible sealing surface, at its matching concave surface 58. Pin 14 is inserted through opening 50 in the plug member and opening 47 in washer 26. Preferably there is a detent 59 into which the end 48 of pin 14 is inserted. All of the above operations are carried out without releasing any pressure from the container. Note that there are no compressible parts. All of the parts have a fixed length for accurate mass assembly of the valve and safety plug. In order to withdraw a part or all of the contents of the container, it is simply necessary to depress lever 13 inserted through opening 102 in the head 10, which causes protrusion 33 to move downwardly against cup 34, which in turn presses downwardly on the head 60 of pin 14 through sealing membrane member 15. Depression of lever 13 causes pin 14 to move downwardly and end 48 to depress valve cup 25, carrying washer 26 with it. Spring 28 is compressed against abutment 45 in the spring retainer 27. Gas pressure within the container forces the carbonated water up through syphon tube 5, through openings 52 and 51 in the spring retainer and into inner chamber 21. The liquid is forced between seal 26 and the valve seat 24 up past the flutes 61 in pin 14 and into chamber 16 in the head. Drain opening 62 permits the liquid under pressure to be propelled through channel 98 in guide member 29 and through channel 17 in the spout 18. As soon as the lever 13 is released, spring 28 forces valve cup 25 to move upwardly and to seal washer 26 against valve seat 24. Pin 14 is forced upwardly and causes lever 13 to return to its raised position. Thus, the container remains charged with sufficient gas to completely empty the container whenever desired at a later time. There is no escape of gases while the lever is in the raised position, since the gas remains in the upper portion of the container and continues to act on the surface 63 of the water, rather than on the seal between washer 26 and seat 24.

Figure 7:
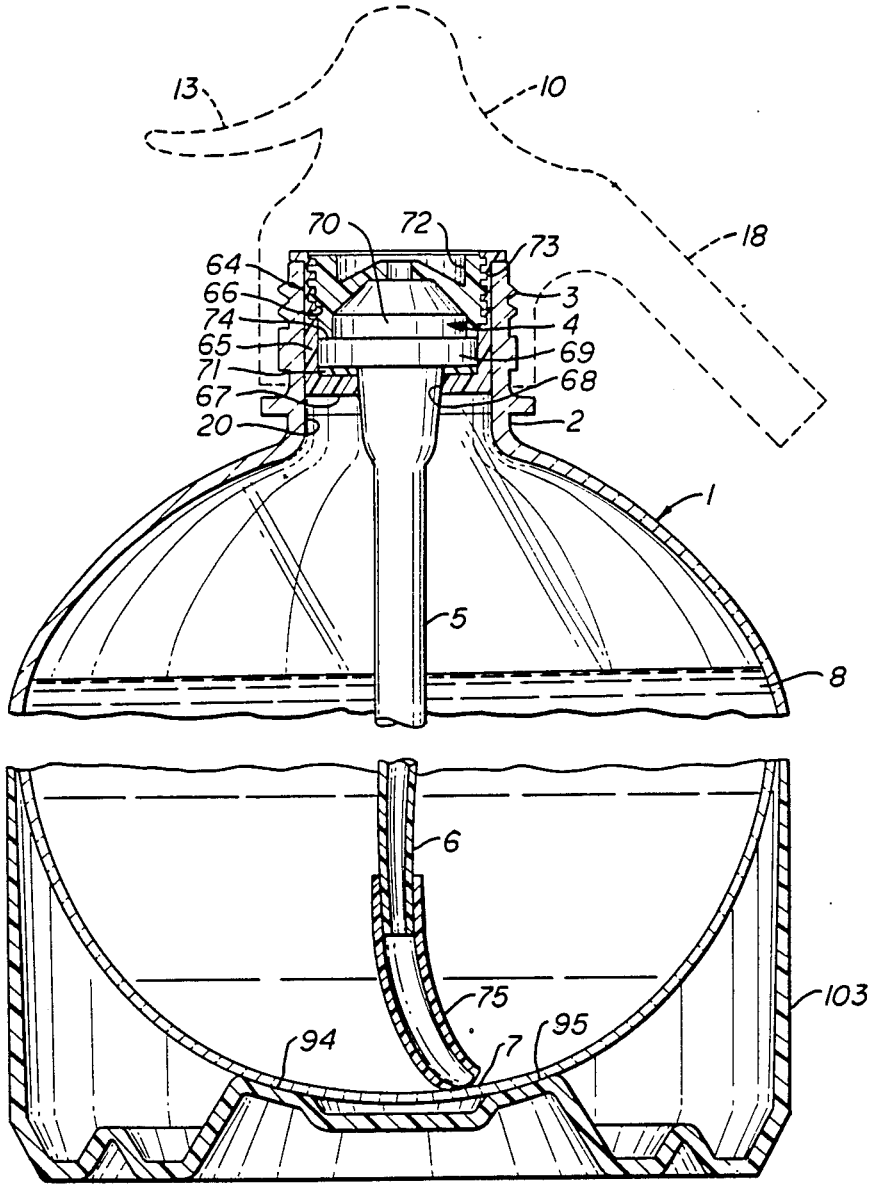
FIG. 7 is a cross sectional view of the container with the mid-portion removed. The disposable cap has been removed and the head is shown in phantom line. An alternate form of valve and plug is shown. Another syphon tube and end member is shown.

FIG. 7 illustrates a modified form of the invention. The head member is identical to the head illustrated in FIG. 3 and previously described and operates in an identical manner. A neck cup member 64 is provided, having a thin upright wall 65 formed with internal threads 66. A base 67 is formed with an opening 68. The upright wall 65 is attached to the inner wall 20 of the bottle by a suitable adhesive. A syphon tube 5 is placed through opening 68 having a flange 40 which is surrounded by flange 69 on valve housing 70. A rubber washer 71 provides the seal between base 67 and flange 69 to prevent liquid and gas from escaping from the container. A safety neck plug member 72 having external threads 73 which threadably mate with the internal threads 66 of the neck cup member 64 clamps against shoulder 74 holding flange 69 in sealing engagement with washer 71. The valve assembly within valve housing 70 carries a spring retainer 27, spring 28, valve cup 25 and washer 26, which are identical to the parts illustrated in FIG. 4.

Operation of the valve in FIG. 7 is identical to the valve described above and illustrated in FIGS. 2–4 and the description is not repeated.

The end member 75 on the end 6 of syphon tube 5 is formed from a flexible substance, such as rubber, so that the contraction of bottle 1 will cause the end member 75 to bend, rather than break the syphon tube.

Figure 8:
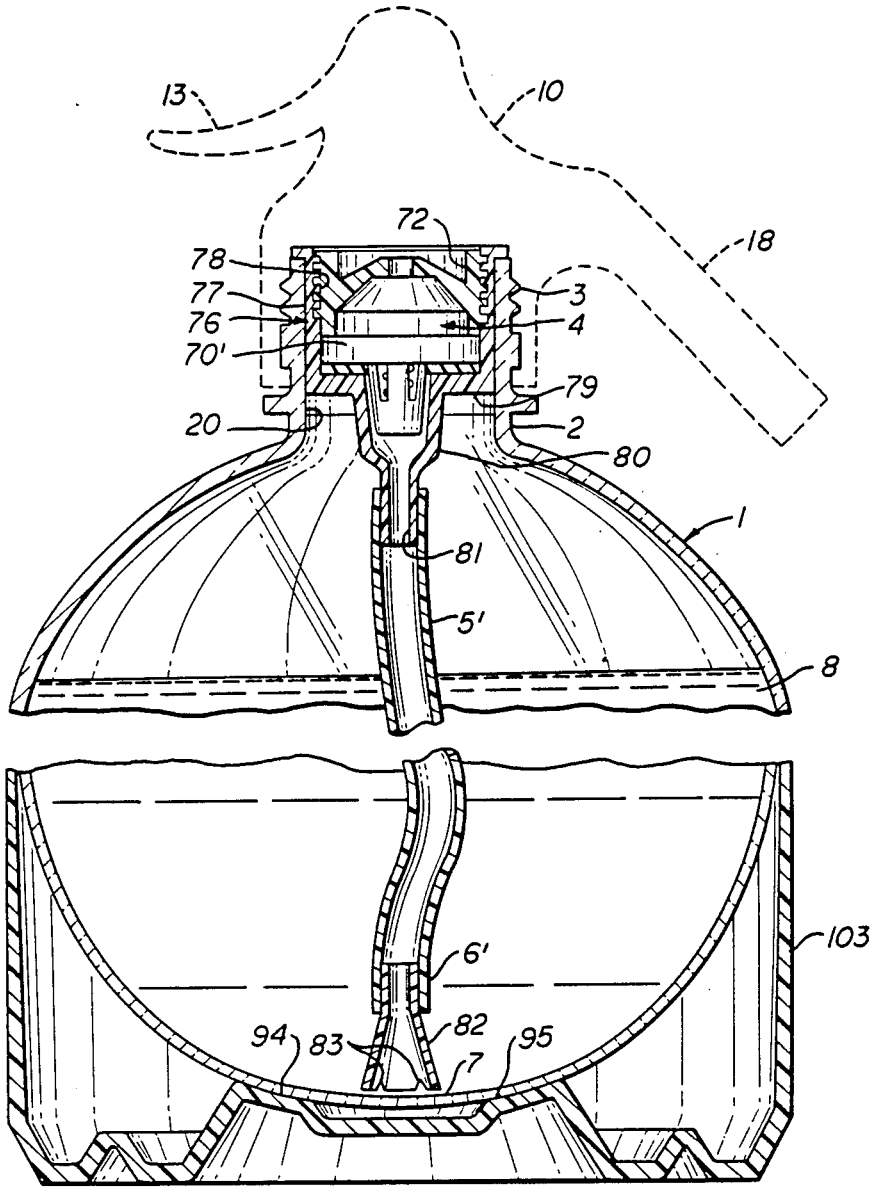
FIG. 8 is a cross sectional view of the container with the mid-portion removed. The disposable cap has been removed and the head is shown in phantom line. Still another form of the valve and syphon tube is shown. The device is shown with a flexible syphon tube and rigid syphon end member.

Another modified form of the invention is illustrated in FIG. 8. This form is nearly identical to the form of the invention shown in FIG. 7 with the exception that the neck cup member and a portion of the syphon tube are formed as one piece. Specifically, the modified neck cup member 76 includes a thin upright wall 77 formed with internal threads 78, a base 79 which is formed with an annular wall 80, which reduces in diameter to an elongated tubular member 81. A flexible syphon tube 5' connects to the end of member 81 and extends to a termination point 6' to which a flared end member 82 is attached. Openings 83 in the end member permit liquid to pass upward through the syphon tube.

The valve housing 70' is similar to the valve housing in FIG. 7 except that it is not joined to the syphon tube. All the valve parts including the spring retainer 27, spring 28, valve cup 25, washer 26 are identical to the parts illustrated in FIG. 7 and previously described. The safety neck plug 72 is identical to the plug of the same member in FIG. 7.

Operation of the valve member and head member 10 is identical to the operation previously described and is not repeated.

Figure 9:
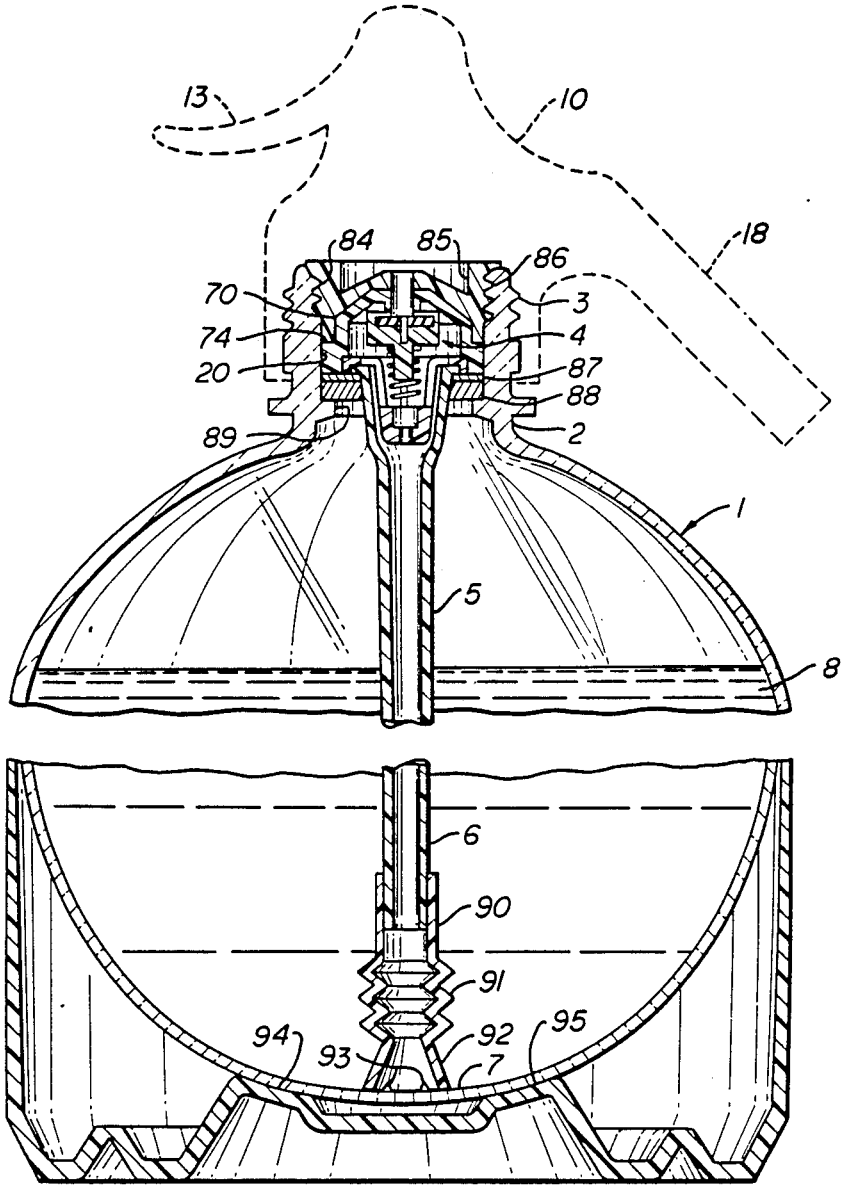
FIG. 9 is a cross section of the container with the mid-portion removed. The disposable cap has been removed and yet another form of valve and safety neck plug member is shown.
Figure 10:
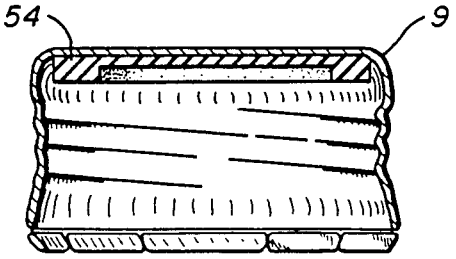
FIG. 10 is a side view of a standard disposable cap member for the container shown on an enlarged scale.

Still another form of the invention is illustrated in FIG. 9. This form of the invention is similar to the form illustrated in FIG. 7, except that instead of a neck cup member 64, internal threads 84 are formed in the neck portion of the container and the valve housing 70 is held in place by a modified safety neck plug member 85, which is formed with external threads 86, which threadably match with threads 84 in the container. All of the valve parts are identical to those shown in FIG. 4, including the spring retainer 27, spring 28, valve cup 25 and washer 26. The valve housing is identical to the valve housing 70 in FIG. 7. Operation of the valve is identical to the valves previously described, and head member 10 is identical to the previously described heads. Sealing of the liquid in the container is effected by turning modified safety neck plug 85 down against shoulder 74 of the valve housing which in turn presses down on tube sealing washer 87 and neck sealing washer 88. The seal is effected between washer 88 and internal annular flange 89 formed in the inside wall of the neck of the bottle.

FIG. 9 illustrates still another end member 90 attached to the syphon tube. The end member is made of flexible material shaped in the form of a bellows 91 with a flared end portion 92 formed with openings 93. Thus, when the length of the bottle changes, the bellows portion will flex and exert little or no pressure on the syphon tube, which is fixed between the valve housing and sealing washer 87.

Figure 5:
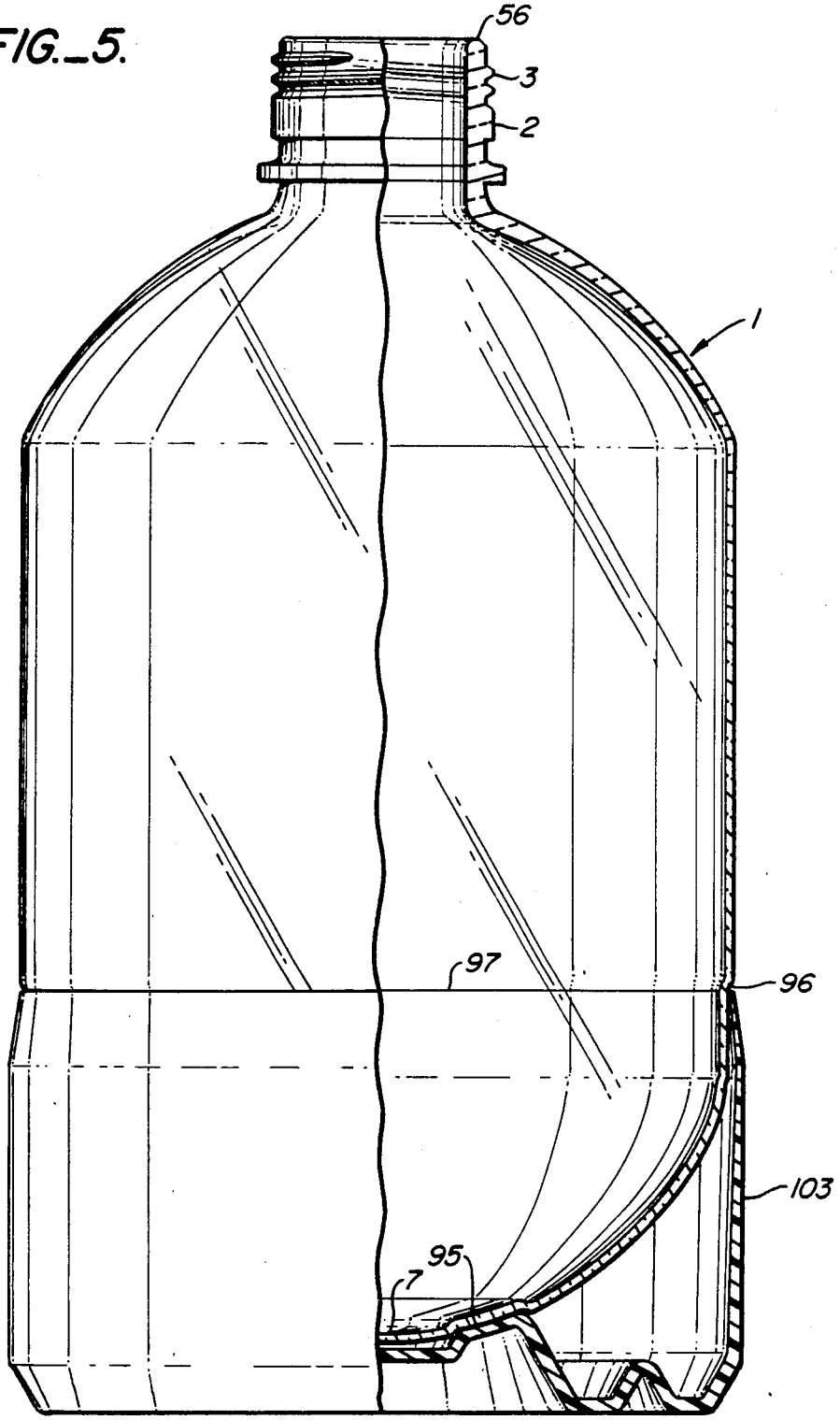
FIG. 5 is an enlarged side view of the container of the present invention with a portion in cross section. The bottle is attached to a base for convenience in standing in a vertical position. This view shows the shape of the bottle prior to filling.
Figure 6:
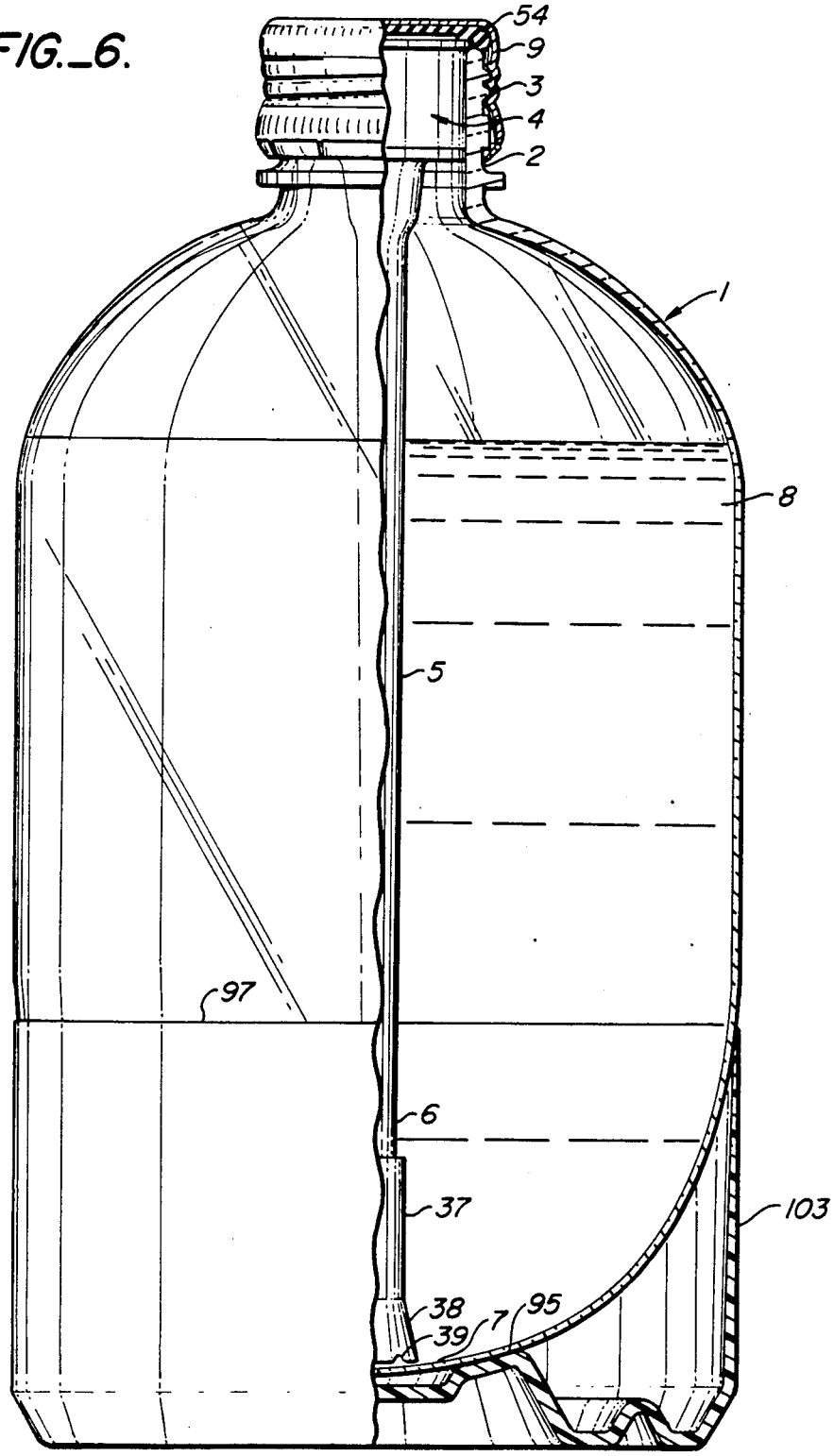
FIG. 6 is a side view of the container of FIG. 5 with portions in cross section. The container is shown filled with carbonated water and is under pressure of between 90 to 150 psi. The valve and disposable cap are shown on the sealed and filled container.

It is standard practice in industry to provide a plastic base member for plastic bottles. The drawings illustrate such a standard base as indicated by the number 103. The base is attached to the bottle by applying adhesive at areas 94 and 95. By applying the adhesive to the base of the bottle and an upper part of the base, the base will remain affixed to the bottle in spite of the expansion and contraction of the bottle which results from the varying pressure in the bottle, as affected by varying temperature and varying fill levels of the bottle. The difference in shape of the bottle is shown in FIG. 5 when the bottle is empty and in FIG. 6, which shows the shape of the bottle when it is filled and pressurized. Note particularly the indentation along line 96 in FIG. 5 at a point just above the top edge 97 of the base 103. In FIG. 6, when the bottle is filled, indent 96 disappears and becomes a smooth curved line. Some vertical growth occurs in the bottle, but it is not as dramatic as the diameter expansion. The difference in vertical height is, however, of sufficient importance that is necessary to make provision for this dimensional change as has been described above in the various syphon tube end members and the provision for openings in the edge of the end member.

It is not intended that cap 9 be subject to pressure at any time. If, however the valve should leak, and build-up pressure, danger from the cap may be obviated by providing a plurality of vertical slots in the outer sidewall of the neck of the bottle which cross threads 3. Thus, when the cap is loosened, if there should accidently happen to be any pressure against the cap, the pressure would safely vent through the vertical slots to atmosphere, the instant the cap seal was broken. The vertical slot system is presently found on plastic bottles which are under light carbonation.

Figure 11:
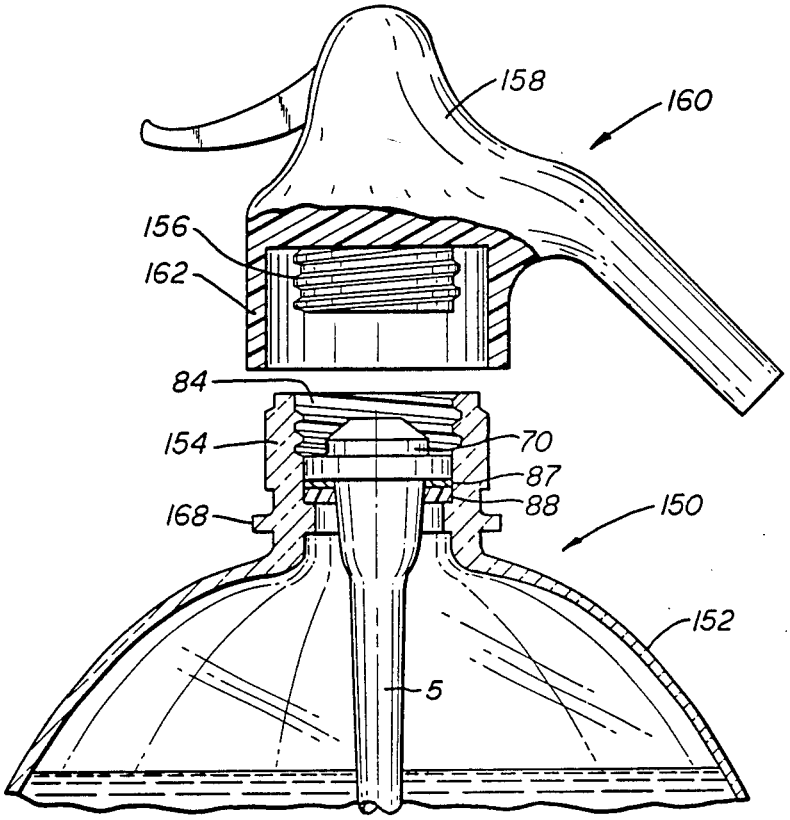
FIG. 11 is a partial cross section and partial exploded view of a portion of another embodiment of the invention.
Figure 12:
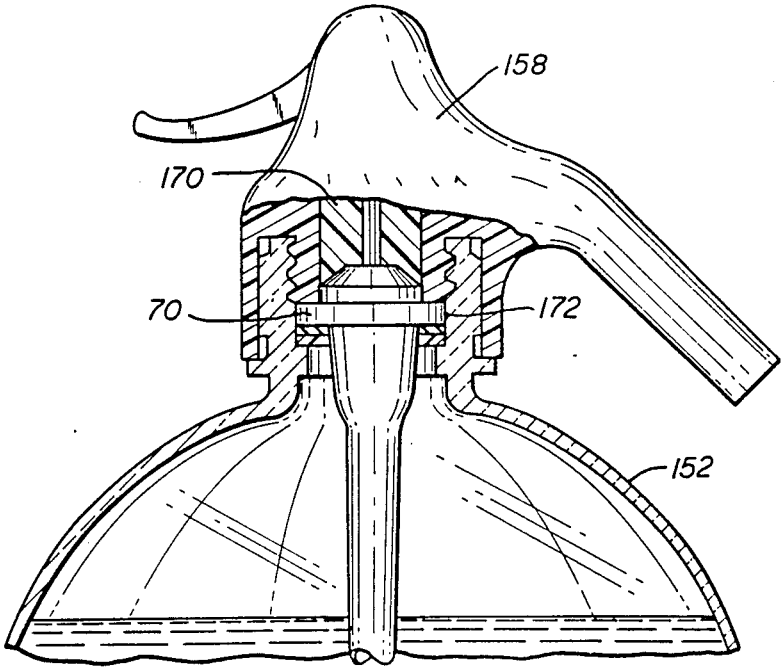
FIG. 12 is a cross section view of the FIG. 11 embodiment in assembled form.

FIGS. 11 and 12 show another embodiment of a syphon seltzer water package 150 in accordance with the invention. In this package 150, valve housing 70, and the internal valve parts, tube sealing washer 87, neck sealing washer 88 and tube 5 have the same configuration as the FIG. 9 embodiment. Bottle 152 has the same configuration as the bottle 1 in FIG. 9, except that neck 154 of the bottle 152 does not have external threads. Internal threads 84 of the neck 154 mate with threads 156 on body 158 of head 160. Body 158 has a flange 162, which fits along external surface 164 of the neck 154, so that end 166 of the flange 162 engages flange 168 of the neck 154 when the head 160 is screwed into the neck 154. Flanges 162 and 168 interact to provide support for the head 160 against lateral shearing forces, such as might occur if the package 150 were dropped. Guide member 170 inside the head body 158 is shaped to engage the valve housing 70. The valve housing 70 is spin or ultrasonic welded to the inside surface 172 of the neck 154. A modified form of a cap closure is provided over the neck 154 of the bottle, which cap closure is removed by the user at the time of attaching the head 160. In other respects, the construction and operation of the FIG. 11–12 embodiment is the same as the FIG. 9 embodiment.

Figure 13:
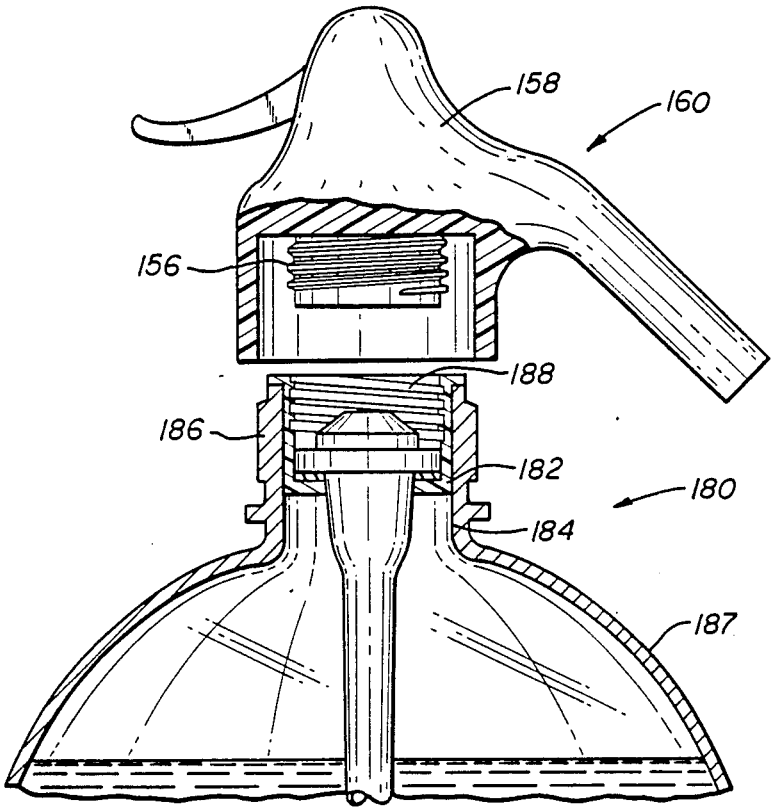
FIG. 13 is a partial cross section and partial exploded view of a portion of still another embodiment of the invention.
Figure 14:
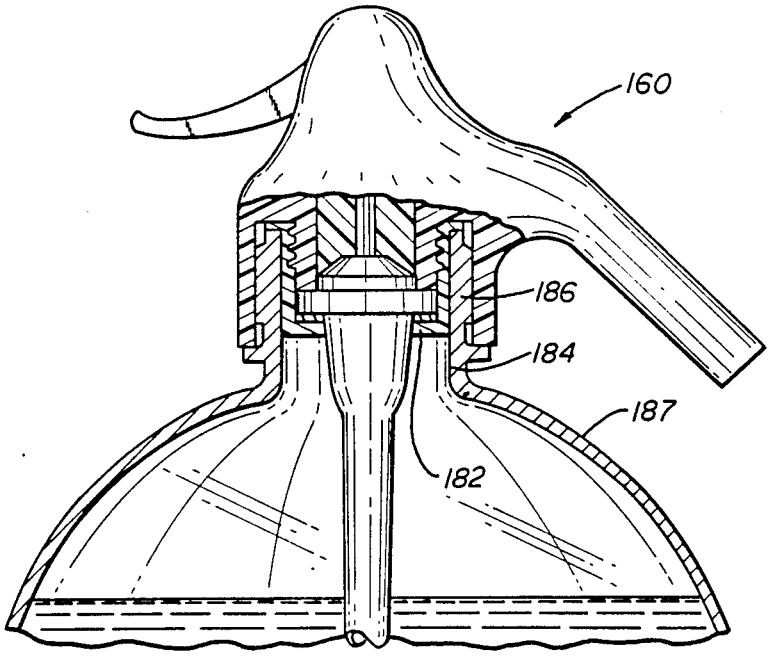
FIG. 14 is a cross section view of the FIG. 13 embodiment in assembled form.

FIGS. 13 and 14 show still another embodiment of a syphon seltzer water package 180 in accordance with the invention. In the package 180, insert 182 is spin or ultrasonic welded to internal surface 184 of bottle neck 186 to which a heat sensitive, FDA approved adhesive has been previously applied. Bottle 187 is formed of aluminum. Insert 182 has internal threads 188 which mate with threads 156 on the syphon head body 158. Syphon head 160 has the same configuration as in the FIGS. 11–12 embodiment. In other respects, the construction and operation of the FIGS. 13–14 embodiment is the same as the FIGS. 11–12 embodiment.

It should be apparent to those skilled in the art that various changes in form and details of the invention as shown and described may be made. It is intended that such changes be included within the spirit and scope of the claims appended hereto.

What is claimed is:

1. A method for storing and dispensing fluids contained under gas pressure comprising:

(a) selecting a substantially non-frangible plastic container capable of safely withstanding in excess of three atmospheres of pressure, said container having a longitudinal axis and being formed with a neck portion having an internal annular wall having a substantial surface area generally parallel to said longitudinal axis and including an opening, said container having an attachment member formed on said neck portion adapted for removably affixing a head member to said attachment member for dispensing fluid from said container;

(b) selecting a valve means having an external annular wall dimensioned for gas sealing and structural connection to said internal annular wall of said neck portion mounted substantially within said container neck portion for maintaining gas pressure of at least three atmospheres and having a passage formed therein adapted for receiving a valve actuating member;

(c) mounting a syphon tube within said container having a distal end adjacent the bottom of said container and operatively connected to said valve means;

(d) bonding said external annular wall of said valve means to said internal wall of said neck portion;

(e) filling said container through said value means with a liquid under at least 3 atmospheres of pressure;

(f) selecting a removable sanitary sealing means covering said opening in said neck of said container, which removable sanitary sealing means is a cap member having internal threads and has sufficient structural integrity to prevent expulsion of said valve means under normal working pressures present in said container, and wherein said attachment member is external screw threads formed in said neck portion adjacent said neck opening for threadable registration with said cap threads, and (g) selecting a head member having a manually engageable valve actuating member, a remote valve actuating member selectively operable by said valve actuating member and positioned for engagement with said valve means, said head member having a liquid and gas substantially impermeable resilient means forming a sealed top of said open ended chamber and separating said manually engageable valve actuating member and said remote valve actuating member, said sealed top resilient separating means being free to move so that downward motion of said manually engageable valve actuating member is transmitted to said remote valve actuating member, said remote valve actuating member extending below said sealed top resilient separating means to open said valve in response to the downward motion of said manually engageable valve actuating member, said head member having internal threads for registeration with said screw threads formed in said neck portion.

2. A container system for storing and dispensing a carbonated beverage comprising:

(a) a substantially non-frangible plastic container capable of safely withstanding in excess of three atmospheres of pressure, said container having a longitudinal axis and being integrally formed with a neck portion having an internal annular wall having a substantial surface area generally parallel to said lognitudinal axis and including an opening;

(b) a normally closed valve means having an external annular wall dimensioned for gas sealing and structural connection to said internal annular wall of said neck portion mounted substantially within said container neck portion for maintaining gas pressure of at least three atmospheres and having a passage formed therein adapted for receiving a valve actuating member, said external annular wall of said valve means being fixedly attached to said internal wall of said neck portion;

(c) a syphon tube mounted within said container having a distal end adjacent the bottom of said container and an end operatively connected to said valve means;

(d) a threaded cap capable of safely withstanding in excess of three atmospheres pressure and covering said opening in said neck of said container;

(e) integrally formed threads at said neck portion adapted both for directly attaching said cap over said opening in said container and for removably and directly affixing a head member to said neck portion over said opening for dispensing the carbonated beverage from said container; and (f) a removable head member having mating threads integral with said head to attach said removable head directly to said threads at said neck portion over said opening in said container to dispense the carbonated beverage from the container, said head including a manually operable means for temporarily opening said normally closed valve.

3. A container system as described in claim 2 comprising:

(a) a telescoping tube end member having a flared end portion formed with notched openings therein and having a telescoping end dimensioned for frictional sliding fit with said distal end of said syphon tube.

4. A container system as described in claim 2 comprising:

(a) a telescoping tube end member having an end portion formed with notched openings therein and having a telescoping end dimensioned for frictional sliding fit with said distal end of said syphon tube, said telescoping tube end being formed from a flexible material.

5. A container system for storing and dispensing fluids under gas pressure comprising:

(a) a substantially non-frangible container capable of safely withstanding in excess of three atmospheres of pressure, said container having a longitudinal axis and being formed with a neck portion having an internal annular wall having a substantial surface area generally parallel to said longitudinal axis and including an opening;

(b) a valve means having an external annular wall dimensioned for gas sealing and structural connection to said internal annular wall of said neck portion mounted substantially within said container neck portion for maintaining gas pressure of at least three atmospheres and having a passage formed therein adapted for receiving a valve actuating member, said external annular wall of said valve means being fixedly attached to said internal wall of said neck portion;

(c) a syphon tube mounted within said container having a distal end adjacent the bottom of said container and an end operatively connected to said valve means;

(d) a removable sanitary sealing means covering said opening in said neck of said container;

(e) an attachment means at said neck portion adapted for removably affixing a head member to said attachment means for dispensing fluid from said container; and (f) an end tube member having an end portion formed with a flared end having a notched opening therein, being formed from a flexible material, having a bellows type mid-section and being dimensioned for connection to said syphon tube.

6. A container system for storing and dispensing a carbonated beverage comprising:

(a) a substantially non-frangible plastic container capable of safely withstanding in excess of three atmospheres of pressure formed with a neck portion having an internal annular wall and an opening therein;

(b) valve means mounted substantially within said container neck portion for maintaining gas pressure of at least three atmospheres, said valve means including an inner chamber having upper and lower portions open at both ends and a valve seat formed in said upper portion of said chamber, a valve cup positioned for registration with said valve seat in a valve closed position and movable to a valve open position away from said valve seat, sealing means carried by said cup for sealing registration with said valve seat in said valve closed position, a spring retainer member connected to said lower portion of said chamber, and a spring member carried by said spring retainer member and biasing said valve cup to said valve closed position;

(c) an elongated syphon tube operably connected to said valve means and extending to a termination point adjacent said bottom of said container;

(d) manually operable means for selectively opening said valve for release of the contents of said container;

(e) a safety neck plug member enclosing said valve means and integrally connected to said elonated syphon tube and having a wall fixedly attached to said internal annular wall of said neck portion of said container;

(f) a threaded cap capable of safely withstanding in excess of three atmospheres of pressure and covering said opening in said neck of said container;

(g) a head member having a housing forming an open ended chamber and having threads integrally formed with said head configured for removable attachment over the opening of said container neck portion, said head member including a manually engageable valve actuating member, a remote valve actuating member selectively operable by said valve actuating member and positioned for engagement with said valve member, a liquid and gas substantially impermeable resilient means forming a sealed top of said open ended chamber and separating said manually engageable valve actuating member and said remote valve actuating member, said sealed top resilient separating means being free to move so that downward motion of said manually engageable valve actuating member is transmitted to said remote valve actuating member, said remote valve actuating member extending below said sealed top resilent separating means to open said valve in response to the downward motion of said manually engageable valve actuating member, and a spout operably connected to said valve member for selectively discharging the fluid contents of said container through said tube and valve; and (h) threads integrally formed at said neck portion adapted both for removably and directly attaching said cap over said opening in said container and for removably and directly affixing said head member to said neck portion over said opening for dispensing the carbonated beverage from said container.

7. A container system for storing and dispensing fluids under gas pressure comprising:

(a) a substantially non-frangible container capable of safely withstanding in excess of three atmospheres of pressure formed with a neck portion having an internal annular wall and an opening therein;

(b) valve means mounted substantially within said container neck portion for maintaining gas pressure of at least three atmospheres;

(c) an elongated syphon tube operably connected to said valve means and extending to a termination point adjacent said bottom of said container;

(d) manually operable means for selectively opening said valve for release of the contents of said container;

(e) a safety neck plug member enclosing said valve means and integrally connected to said elongated syphon tube and having a wall fixedly attached to said internal annular wall of said neck portion of said container;

(f) an attachment means at said container neck portion adapted for removably affixing a head member to said container for dispensing fluid from said container, wherein:

(g) said attachment means at said neck portion of said container includes external thread members formed in an outer wall of said neck portion;

(h) said manually operable means includes a head member having a housing formed with an open ended chamber having inner walls formed with thread members dimensioned for threadable engagement with said external thread members of said neck portion of said container;

(i) said head member includes a manually engageable valve actuating member, a remote valve actuating member selectively operable by said valve actuating member and positioned for engagement with said valve member, a liquid and gas substantially impermeable means separating said manually engageable valve actuating member and said remote valve actuating member, and a spout operably connected to said valve member for selectively discharging the fluid contents of said container through said tube and valve;

(j) said safety neck plug member has a top wall formed with a convex shape and an opening substantially at an upper part of said top wall;

(k) said head member includes a guide member formed with an opening for receiving said remote valve actuating member therethrough; and (l) said guide member is formed with a concave surface surrounding said guide member opening formed for sealing registration with said convex shaped top wall of said safety neck plug member.

8. A container system for storing and dispensing fluids under gas pressure comprising:

(a) a substantially non-frangible container capable of safely withstanding in excess of three atmospheres of pressure formed with upstanding walls, a bottom, and a neck portion having an inner wall and an outer wall;

(b) a modified neck cup member having an upstanding wall dimensioned for bonding and sealing fit with said inner wall of said neck portion of said container and having a bottom wall, an inner portion of said upstanding wall being formed with internal threads, and an elongated syphon tube member extending to a point adjacent said bottom of said container and having an upper portion integrally connected to said neck cup bottom wall;

(c) valve means including a valve housing having an upper wall mounted substantially within said neck cup for maintaining gas pressure of at least three atmospheres and operably connected in said upper portion of said elongated tube member;

(d) a safety neck plug member formed with outer screw threads for threadable matching with said internal threads in said neck cup member and dimensioned for registration with said upper wall of said valve housing and formed with an opening therethrough;

(e) removable cap means mounted on said neck portion of said container; and (f) manually operable means for selectively opening said valve member when said cap means is removed.

9. A container system as described in claim 8 wherein said substantially non-frangible container is formed from plastic.

10. A container system as described in claim 8 wherein:

(a) said outer wall of said neck portion of said container is formed with thread members; and (b) said cap means includes a top wall and depending side walls formed with internal thread members for threadable registration with said thread members on said container.

11. A container system for storing and dispensing a carbonated beverage, which comprises a substantially non-frangible plastic container having a necked opening with an inside surface and integrally formed threads on an exterior surface, a valve insert fixedly attached to the inside surface of said necked opening, a threaded, removable cap directly attached by said integrally formed threads to said necked opening over said valve insert, and a dispensing head having integrally formed mating threads configured for fixed, removable and direct engagement over said necked opening after removal of said cap by means of the mating threads with said integrally formed threads, said dispensing head having a body including an opening for discharge of the fluid, a valve actuating member in said head configured for operative engagement of said valve when said dispensing head is in fixed engagement over said necked opening, said cap being capable of withstanding the pressure of the carbonated beverage.

12. A container system for storing and dispensing a pressurized fluid, which comprises a substantially non-frangible container having a necked opening with an inside surface, a valve insert fixedly attached to the inside surface of said necked opening, a removable cap attached to said necked opening over said valve insert, and a dispenising head configured for fixed, removable engagement over said necked opening after removal of said cap, said dispensing head having a body including an opening for discharge of the fluid, a valve actuating member in said head configured for operative engagement of said valve when said dispensing head is in fixed engagement over said necked opening, and means for attaching said dispensing head in fixed engagement over said necked opening, said dispensing head attachment means comprising threads on said body configured for engaging mating threads on the inside surface of said necked opening after removal of said cap, said dispensing head body having an inside flange and an outside flange, the body threads being on an outside surface of said inside flange, said outside flange being configured to extend along an outside surface of said necked opening, said necked opening outside surface having an outwardly extending flange, and the outside flange of said body being configured so that an end of the outside flange engages the outwardly extending flange of said necked opening outside surface when said dispensing head is in fixed engagement over said necked opening.

13. A container system for storing and dispensing a pressurized fluid, which comprises a substantially non-frangible container having a necked opening with an inside surface, a valve insert fixedly attached to the inside surface of said necked opening, a removable cap attached to said necked opening over said valve insert, and a dispensing head configured for fixed, removable engagement over said necked opening after removal of said cap, said dispensing head having a body including an opening for discharge of the fluid, a valve actuating member in said head configured for operative engagement of said valve when said dispensing head is in fixed engagement over said necked opening, and means for attaching said dispensing head in fixed engagement over said necked opening, said dispensing head attachement means comprising threads on said body configured for engaging mating threads on said valve insert after removal of said cap, said dispensing head body having an inside flange and an outside flange, the body threads being on an outside surface of said insde flange, said outside flange being configured to extend along an outside surface of said necked opening, said necked opening outside surface having an outwardly extending flange, and the outside flange of said body being configured so that an end of the outside flange engages the outwardly extending flange of said necked opening outside surface when said dispensing head is in fixed engagement over said necked opening.

* * * * *